US012503863B2

(12) United States Patent
Ardern

(10) Patent No.: US 12,503,863 B2
(45) Date of Patent: Dec. 23, 2025

(54) CONSTRUCTIONAL PANEL

(71) Applicant: Fergus Ardern, Norwich (GB)

(72) Inventor: Fergus Ardern, Norwich (GB)

(73) Assignee: Fergus Ardern, Norwich (GB)

( * ) Notice: Subject to any disclaimer, the term of this patent is extended or adjusted under 35 U.S.C. 154(b) by 330 days.

(21) Appl. No.: 18/195,299

(22) Filed: May 9, 2023

(65) Prior Publication Data

US 2023/0366209 A1 Nov. 16, 2023

(30) Foreign Application Priority Data

May 12, 2022 (GB) ..... 2206921

(51) Int. Cl.
*E04F 15/02* (2006.01)

(52) U.S. Cl.
CPC .. *E04F 15/02016* (2013.01); *E04F 15/02022* (2013.01)

(58) Field of Classification Search
CPC ..... E04F 15/02016; E04F 15/02022; E04F 15/06; E04F 15/02183; E04F 15/02038; E04F 15/02166; E04F 15/02161; E04F 15/02172; E04F 15/02405
See application file for complete search history.

(56) References Cited

U.S. PATENT DOCUMENTS 5,050,362 A * 9/1991 Tal ..... E04D 3/363 52/579
5,819,491 A * 10/1998 Davis ..... E04F 15/02161 52/592.1
7,364,383 B2 * 4/2008 Fletcher ..... E01C 9/086 52/592.1

FOREIGN PATENT DOCUMENTS

GB 2307260 A * 5/1997 ..... E01C 9/08

* cited by examiner

*Primary Examiner* — Babajide A Demuren
(74) *Attorney, Agent, or Firm* — Howard & Howard Attorneys PLLC

(57) ABSTRACT

A panel and accompanying method of construction thereof, the panel comprising a first panel element, the first panel element having a substantially planar outer surface, the second, opposite surface having extending therefrom a plurality of paired walls, each pair extending laterally at least partway across the face of the second surface and defining a channel therebetween, a plurality of throughapertures defined in the first panel element, a second panel element having a substantially planar outer surface, and a second, opposite surface having extending therefrom a plurality of paired walls, each pair extending laterally at least partway across the face of the second surface and defining a channel therebetween, the second panel element defining a plurality of throughapertures therethrough, one or more of the throughapertures opening into a tubular element extending from the second surface, a strengthening member located in a channel between paired walls of a panel element.

6 Claims, 5 Drawing Sheets

14
10

13

11b
11a 15
30

20

CONSTRUCTIONAL PANEL

CROSS-REFERENCE TO RELATED APPLICATION

This application claims the benefit of United Kingdom Patent Application No. 2206921.5, filed May 12, 2022, the disclosure of which is hereby incorporated by reference in its entirety.

FIELD OF THE INVENTION

The present invention relates to constructional panels especially suitable for use in ground covering or decking. A plurality of panels is designed to be connected together to form a planar array. In particular, the panel disclosed provides improved strength to the panel and also for easier construction.

BACKGROUND TO THE INVENTION

Panels are widely used, in a variety of situations to cover an area of ground to protect against damage due to people walking on the area or moving vehicles across it. The panels are assembled together, by coupling a panel to adjacent panels, to cover the surface. Although in most cases, the panels are separated from each other for removal and storage, they can remain in place for an extended period: occasionally years.

The panels need therefore to be able to withstand stresses applied by whatever is moving across the surface. This can be a localised stress, such a s a person standing on a panel or a support pole for a structure. The stress can also be of a greater extent such as a vehicle driving across the panel. Although particular care needs to be taken with the joints between adjacent panels, the body of the panel also needs to be able to withstand such forces. Moreover, the panel should ideally be as light as possible to reduce transportation costs and also to reduce the handling risks to a person assembling the panels to form the surface.

It is an object of the present invention to provide a strong and lightweight panel suitable for the uses indicated above. It is a further object of the invention to provide a method of manufacture of such a panel.

SUMMARY OF THE INVENTION

According to a first aspect of the invention, there is provided a panel, the panel comprising a first panel element, the first panel element having a substantially planar outer surface, the second, opposite surface having extending therefrom a plurality of paired walls, each pair extending laterally at least partway across the face of the second surface and defining a channel therebetween, a plurality of throughapertures defined in the first panel element, a second panel element having a substantially planar outer surface, and a second, opposite surface having extending therefrom a plurality of paired walls, each pair extending laterally at least partway across the face of the second surface and defining a channel therebetween, the second panel element defining a plurality of throughapertures therethrough, one or more of the throughapertures opening into a tubular element extending from the second surface, a strengthening member located in a channel between paired walls of a panel element, the first and second panel elements being secured together in fluid-tight manner such that paired walls on the first and second panel elements co-operate to retain the strengthening member and that the free end of a tubular member passes through a throughaperture in the first panel element, a rivet head formed of a plastics material, heat welded to the free end of the tubular member to seal the free end and the throughaperture in the first panel element.

The panel is relatively easily constructed and able to withstand the stress forces applied to such a panel.

Preferably, the tubular member has a conical cross-section to strengthen the panel against downward forces applied.

Preferably, the first panel element includes a receiver to receive the tubular member, the receiver further preferably having a shape complementary to that of the tubular member to form a push-fit connection therewith.

According to a second aspect of the invention, there is provided a method of constructing a panel, the method comprising the steps of selecting a first panel element, the first panel element having a substantially planar outer surface, the second, opposite surface having extending therefrom a plurality of paired walls, each pair extending laterally at least partway across the face of the second surface and defining a channel therebetween, a plurality of throughapertures defined in the first panel element, selecting a second panel element having a substantially planar outer surface, and a second, opposite surface having extending therefrom a plurality of paired walls, each pair extending laterally at least partway across the face of the second surface and defining a channel therebetween, the second panel element defining a plurality of throughapertures therethrough, one or more of the throughapertures opening into a tubular element extending from the second surface, selecting a strengthening member and inserting said strengthening member in the channel between paired walls of a panel element, the method comprising the further step of bringing the first and second panel elements together such that paired walls on the first and second panel elements co-operate to retain a strengthening member and that the free end of a tubular member passes through a throughaperture in the first panel element, sealing the first and second panel elements together in fluid-tight manner, placing a rivet head formed of a plastics material in contact with a free end of a tubular member and heat welding the rivet to the tubular member to seal the free end and the throughaperture in the first panel element.

Preferably, the tubular member has a conical cross-section to strengthen the panel against downward forces applied.

Preferably, the first panel element includes a receiver to receive the tubular member, the receiver further preferably having a shape complementary to that of the tubular member to form a push-fit connection therewith.

DETAILED DESCRIPTION OF THE INVENTION

Constructional panels of the type contemplated herein are widely used in the entertainment industry to convert and/or protect the surface of an arena, such as a sports arena. Where, for example, the arena has a grass surface on which sport is played, then this surface needs to be converted into an area on which an audience can move around and on which chairs can be placed without the grass being damaged. The panels are assembled together to cover the surface. It is important that the surface provided for the audience does not present trip hazards to the audience, and so care needs to be taken that the edges along which adjacent panels are joined together are at the same level. Moreover, such a level surface must not deform too much with the changing mass applied to it. Once the particular event is over, then the panels usually need to be easily removed and stored for future events.

As well as in the entertainment industry, such surfaces can also be used to transform a field or the like into an area on which vehicles, including aircraft, can move around and also be stored. It is important therefore that the individual panels be strong enough to support the mass applied.

Figures 1A, 1B, 1C, 1D, 1E, 1F, 1G:
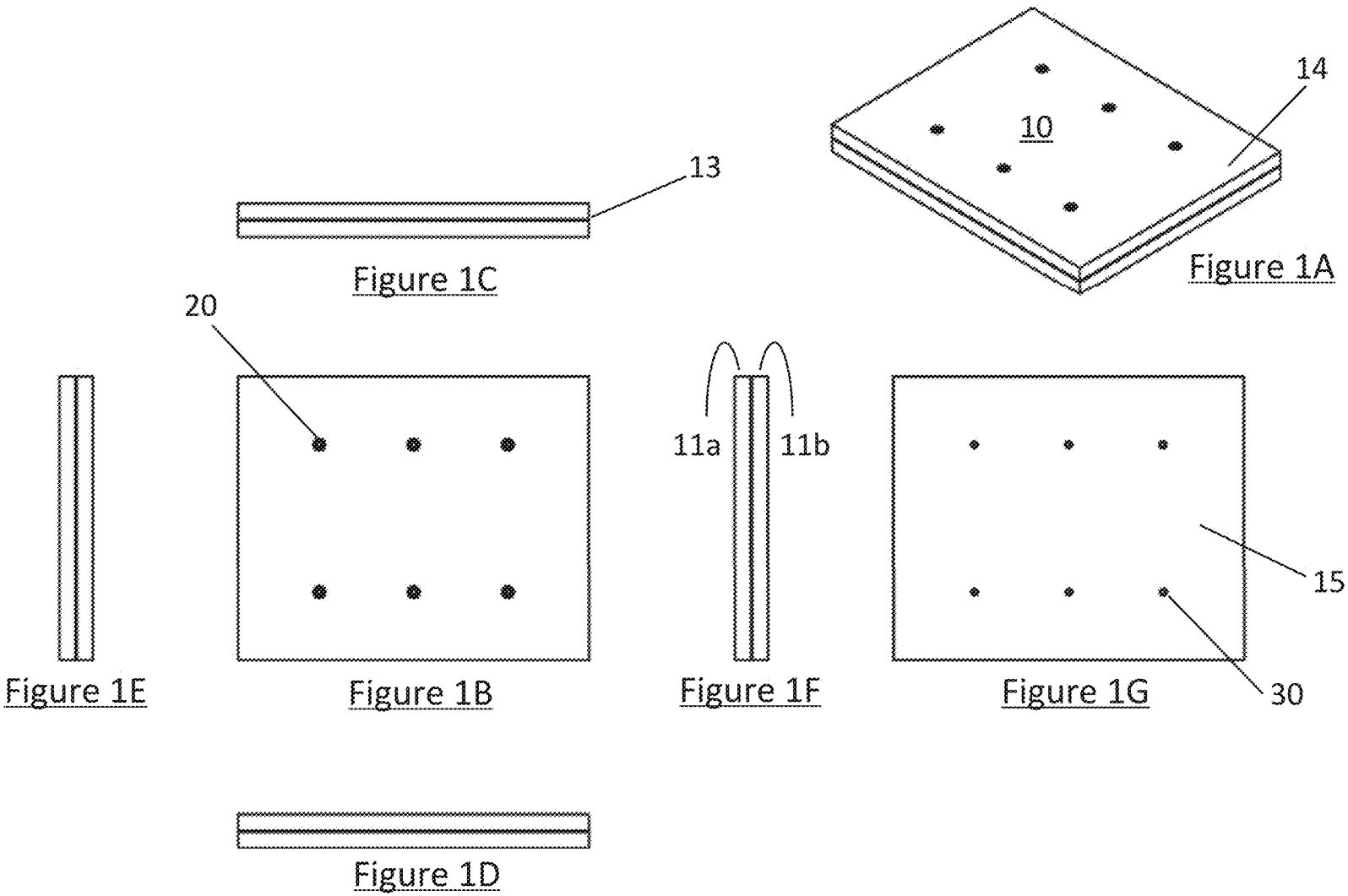
FIGS. 1A-1G show, respectively, a perspective, top, first and second side, first and second ends, and bottom view of an embodiment of floor panel.
Figure 2:
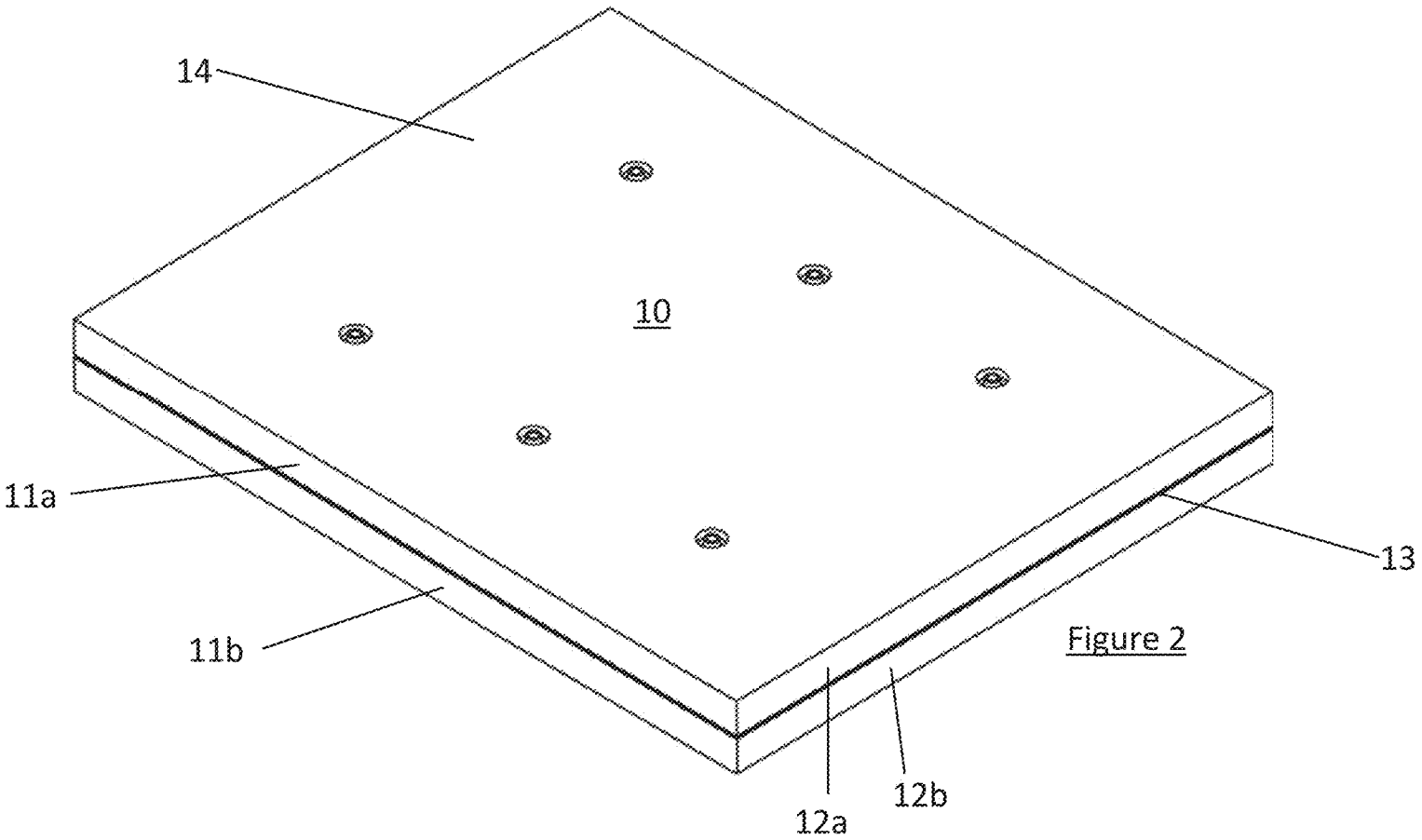
FIG. 2 shows the perspective view of FIG. 1A in more detail.
Figure 3:
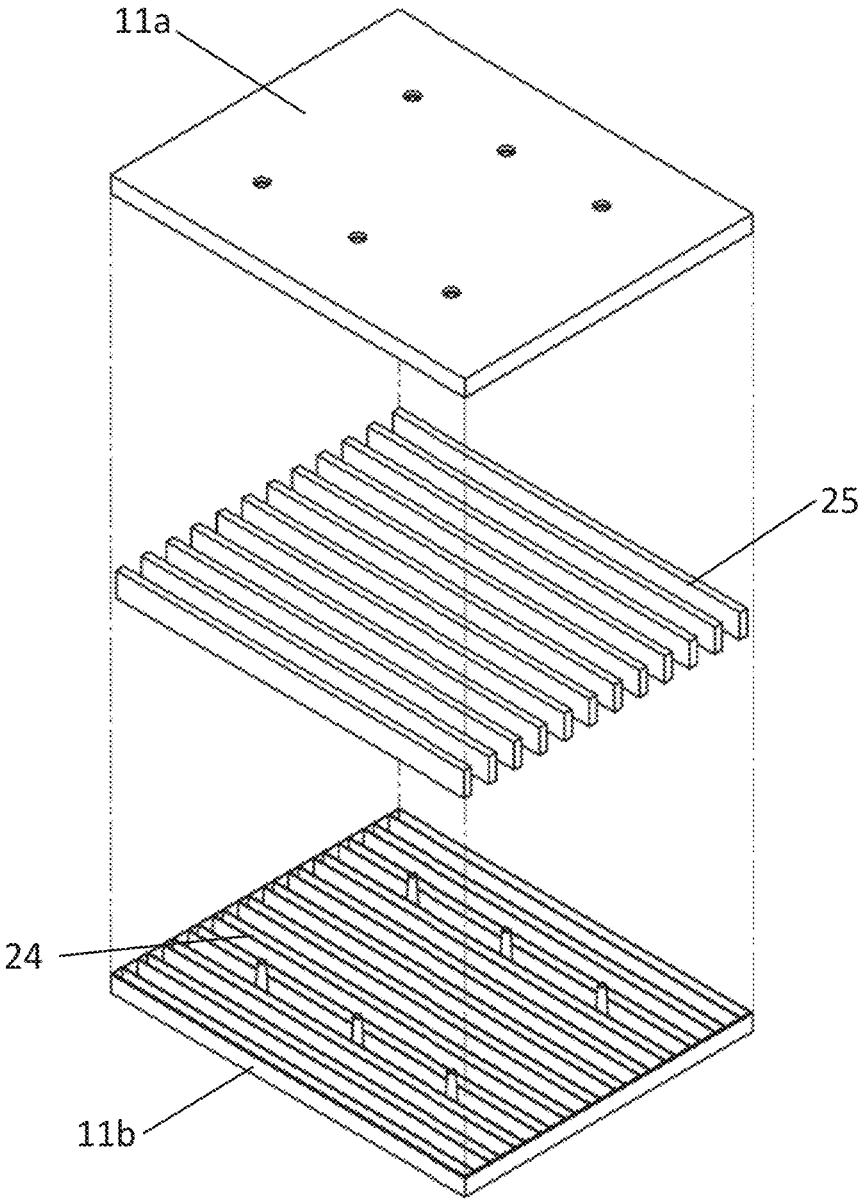
FIG. 3 is an exploded view of the panel of FIGS. 1A-1G.
Figure 4:
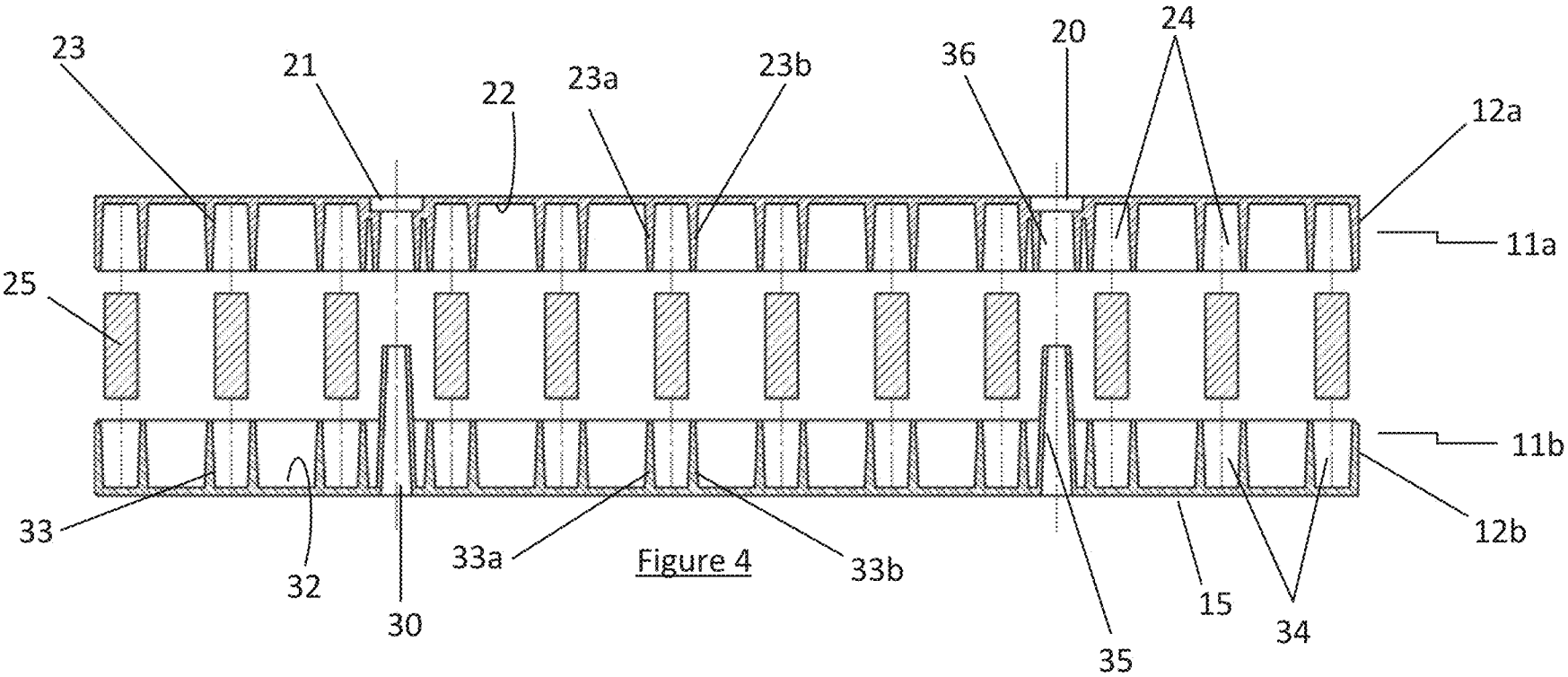
FIG. 4 is a first sectional view of a panel prior to the elements being secured together.

Such a panel is shown in FIGS. 1A-5. The panels illustrated in the Figures can be releasably joined together by securing means (not shown), to neighbouring panels to form a continuous surface. Turning initially to FIGS. 1A and 2, these show a panel in accordance with the current invention and constructed in accordance with a method thereof. The panel, generally referenced 10, has a rectangular cuboid shape, although other shapes can be chosen for the panel without departing from the invention. The panel 10 comprises two sections, 11*a*, 11*b*, each having a peripheral side wall 12*a*, 12*b*, which are joined together along a line 13 by means of a heat weld, forming a fluid-tight seal.

The panel 10 has an in-use upper, planar surface 14 and a lower surface 15 which faces and is in contact with the ground during use. The plastics material from which the panel 10 is formed is chosen to suit the intended use, but is typically a mouldable plastics material such as polypropylene or co-polymer thereof Regarding the section 11*a*, this includes throughapertures 20, formed through the upper surface 14 connecting the internal volume of the panel 10 with the outside. Additionally, around a throughaperture 20, the surface 14 is recessed to form a recess 21 (see FIG. 4) to accommodate a rivet (not shown). Extending from the inside surface 22 of the section 11*a*, is a plurality of walls 23. The walls 23 extend laterally across the inside surface 22 across the width of the section 11*a*. In further embodiments, not illustrated, a wall extends partially across the width of the section 11*a*, which reduces the weight of the panel 10. The walls 23 are deployed in pairs 23*a*, 23*b* defining therebetween a channel 24 in which a strengthening member 25 is housed.

A plurality of walls 33 similarly extends at least partially across the inside surface 32 of the section 11*b*, with the walls 33 being deployed pairwise 33*a*, 33*b* to form channels 34 therebetween. Throughapertures 30 are also defined in the lower surface 15. The side of the throughaperture 30 extends away from the lower surface 15 towards the section 11*a* to form a tube 35, open at both ends which in the embodiment shown has a frusto-conical cross-section.

Figure 5:
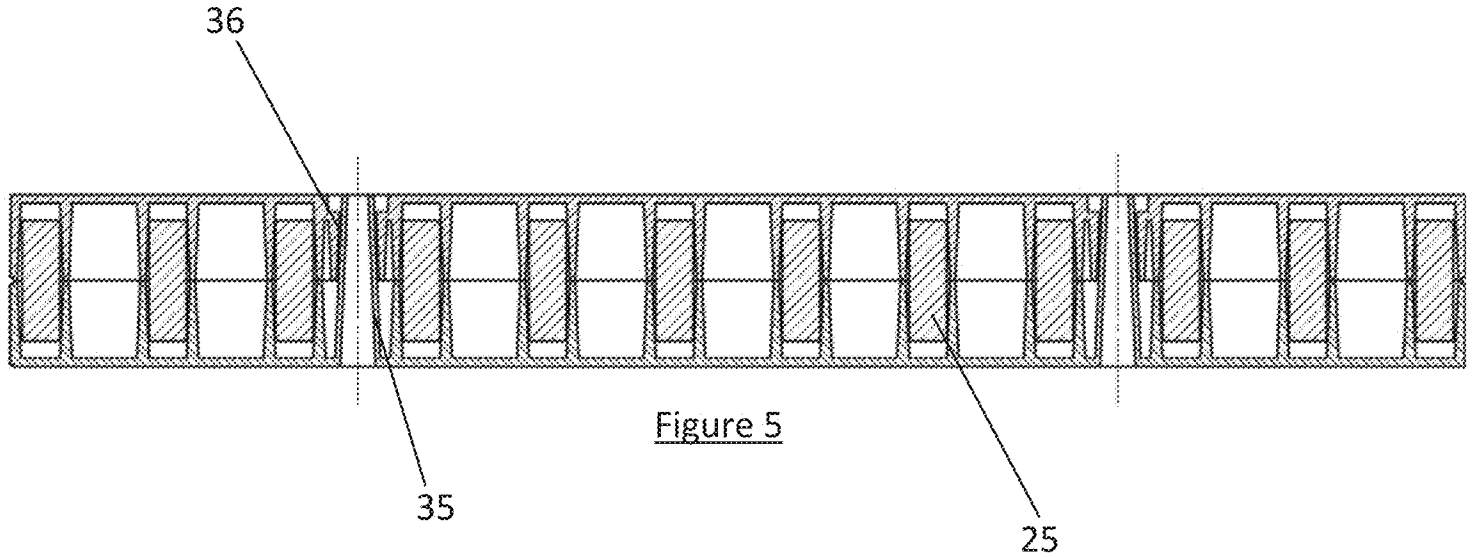
FIG. 5 is a second sectional view of the panel of FIG. 4 with the elements secured together.

When the two sections 11*a*, 11*b* are brought together as is illustrated in FIG. 5, the tube 35 is in contiguous engagement with the walls of a receiver 36 of complementary cross-section to the tube 35. Preferably, the tube forms a friction-fit connection with the receiver 36. As can also be seen from FIG. 5, once the sections 11*a*, 11*b* of the panel are brought together, the strengthening members 25 are housed in and extend along the channels 24 to resist deformation of the panel 10 when a stress force is applied.

In order to construct a panel 10 in accordance with the invention therefore, panel sections 11*a*, 11*b* are selected. Elongate strengthening members 25 are placed inside the channels 24 in one or both of the panel sections 11*a*, 11*b*. Care is taken that strengthening members 25 housed in opposing channels of the sections 11*a*, 11*b* do not prevent the sections 11*a*, 11*b* from being brought together. The sections 11*a*, 11*b* are then brought together so that the edges of the side walls 12*a*, 12*b* are sufficiently close to each other, to allow the edges to be secured together in a fluid-tight manner such as by welding.

As the sections 11*a*, 11*b* are brought together, the tubes 35 pass through a corresponding receiver 36 such that the end of a tube 35 extends into the recess 21 with the outside wall of the tube 35 in contact with the wall of the receiver 36. The edges are welded together. Additionally, rivets are welded to the top of each tube 35. As the tubes 35 and rivets are formed of a plastics material, the welding can be through the application of heat to raise the plastics material above its glass transition temperature so that the material can flow and be moulded. The rivet and the top of the tube 35 are formed to seal the end of the tube 35 and also to seal the tube 35 against the recess 21 to prevent fluid penetrating inside the panel 10.

What is claimed is:

1. A panel, the panel comprising a first panel element, the first panel element having a substantially planar outer surface, a second, opposite surface having extending therefrom a plurality of paired walls, each pair extending laterally at least partway across the face of the second surface and defining a channel therebetween, a plurality of throughapertures defined in the first panel element, a second panel element having a substantially planar outer surface, and a second, opposite surface having extending therefrom a plurality of paired walls, each pair extending laterally at least partway across the face of the second surface and defining a channel therebetween, the second panel element defining a plurality of throughapertures therethrough, one or more of the throughapertures opening into a tubular element extending from the second surface, a strengthening member located in a channel between paired walls of a panel element, the first and second panel elements being secured together in fluid-tight manner such that paired walls on the first and second panel elements co-operate to retain the strengthening member and that the free end of a tubular member passes through a throughaperture in the first panel element, a rivet head formed of a plastics material, heat welded to the free end of the tubular member to seal the free end and the throughaperture in the first panel element.

2. A panel according to claim 1, wherein the tubular member has a conical cross-section to strengthen the panel against downward forces applied.

3. A panel according to claim 1, wherein the first panel element includes a receiver to receive the tubular member, the receiver further preferably having a shape complementary to that of the tubular member to form a push-fit connection therewith.

4. A method of constructing a panel, the method comprising the steps of selecting a first panel element, the first panel element having a substantially planar outer surface, a second, opposite surface having extending therefrom a plurality of paired walls, each pair extending laterally at least partway across the face of the second surface and defining a channel therebetween, a plurality of throughapertures defined in the first panel element, selecting a second panel element having a substantially planar outer surface, and a second, opposite surface having extending therefrom a plurality of paired walls, each pair extending laterally at least partway across the face of the second surface and defining a channel therebetween, the second panel element defining a plurality of throughapertures therethrough, one or more of the throughapertures opening into a tubular element extending from the second surface, selecting a strengthening member and inserting said strengthening member in the channel between paired walls of a panel element, the method comprising the further step of bringing the first and second panel elements together such that paired walls on the first and second panel elements co-operate to retain a strengthening member and that the free end of a tubular member passes through a throughaperture in the first panel element, sealing the first and second panel elements together in fluid-tight manner, placing a rivet head formed of a plastics material in contact with a free end of a tubular member and heat welding the rivet to the tubular member to seal the free end and the throughaperture in the first panel element.

5. A method according to claim 4, wherein the tubular member has a conical cross-section to strengthen the panel against downward forces applied.

6. A method according to claim 4, wherein the first panel element includes a receiver to receive the tubular member, the receiver further having a shape complementary to that of the tubular member to form a push-fit connection therewith.

* * * * *